United States Patent [19]

Silbernagel

[11] 3,969,035

[45] July 13, 1976

[54] SLIP FROM PAVING MACHINE

[75] Inventor: Frederick J. Silbernagel, Huron, S. Dak.

[73] Assignee: Precision Paving Products Corporation, Minneapolis, Minn.

[22] Filed: Feb. 28, 1974

[21] Appl. No.: 446,731

[52] U.S. Cl. ..... 404/98

[51] Int. Cl.[2] ..... E01C 19/52

[58] Field of Search ..... 404/98, 104, 108, 84; 198/65

[56] References Cited

UNITED STATES PATENTS

| | | | |
|---|---|---|---|
| 1,018,780 | 2/1912 | Rauschenbach | 404/98 |
| 2,660,937 | 12/1953 | Breeden | 404/104 |
| 3,053,156 | 9/1962 | Jennings | 404/98 |
| 3,130,654 | 4/1964 | Apel | 404/104 |
| 3,158,945 | 12/1964 | Curlett | 404/84 X |
| 3,223,006 | 12/1965 | Jones | 404/98 |
| 3,258,082 | 6/1966 | Amos | 404/84 X |
| 3,267,824 | 8/1966 | Hudis | 404/108 X |
| 3,665,821 | 5/1972 | Walker | 404/98 |
| 3,710,695 | 1/1973 | Miller | 404/98 X |
| 3,792,133 | 2/1974 | Goughnour | 404/98 X |
| 3,844,670 | 10/1974 | Perkins | 404/104 |

*Primary Examiner*—Nile C. Byers
*Attorney, Agent, or Firm*—Dugger, Johnson & Westman

[57] ABSTRACT

A slip form paving machine for forming curbs, gutters, barriers and other structures in a continuous process. The machine is mounted on three steerable and individually powered wheels. The wheels are mounted on parallel linkages so that the frame can be raised and lowered relative to the wheels without changing the orientation of the steering axis, to permit and insure precise control. A wide variety of paving forms of different heights and widths can be used without modifying the machine. The engine and other heavy components are located in relation to the wheel mounting so that the frame is balanced and stable with the three wheel support. The operational components of the machine including a loading conveyor are stored within a standard frame width so that the unit can be transported over the road without special permits.

21 Claims, 15 Drawing Figures

FIG. 4
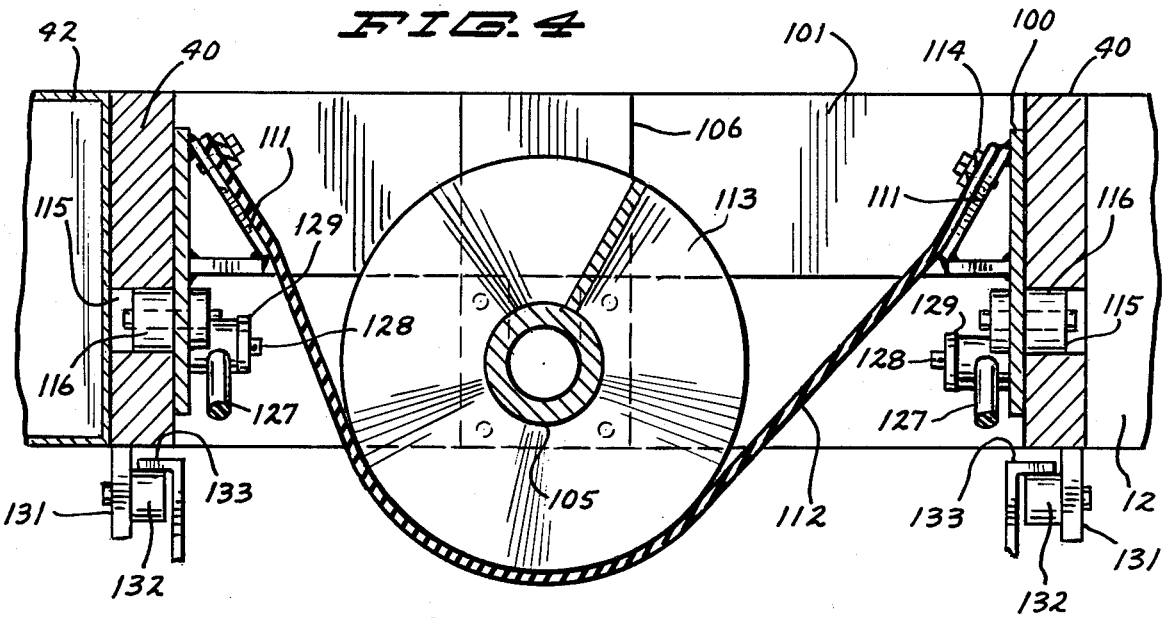
FIG. 8
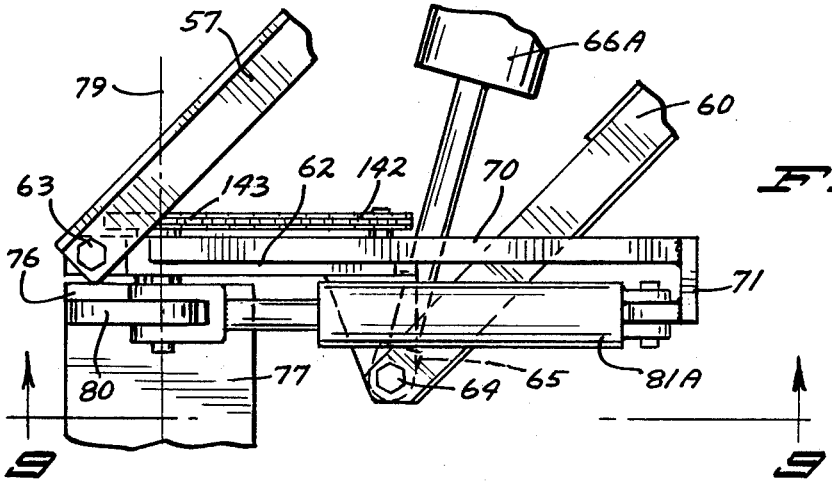
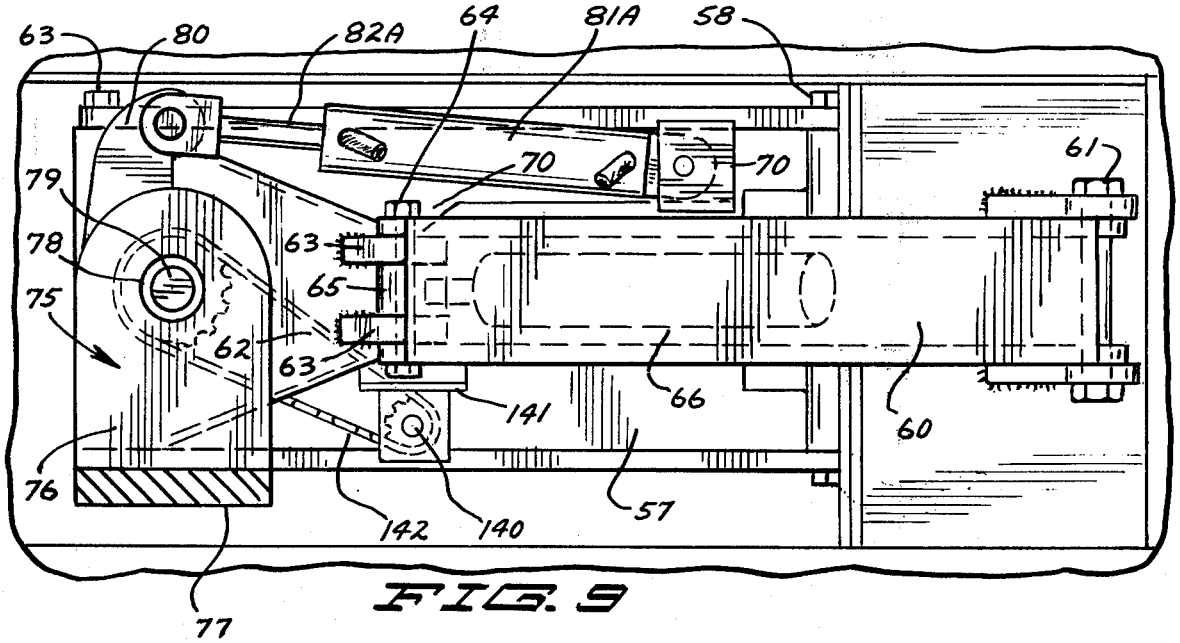
FIG. 9

FIG. 11
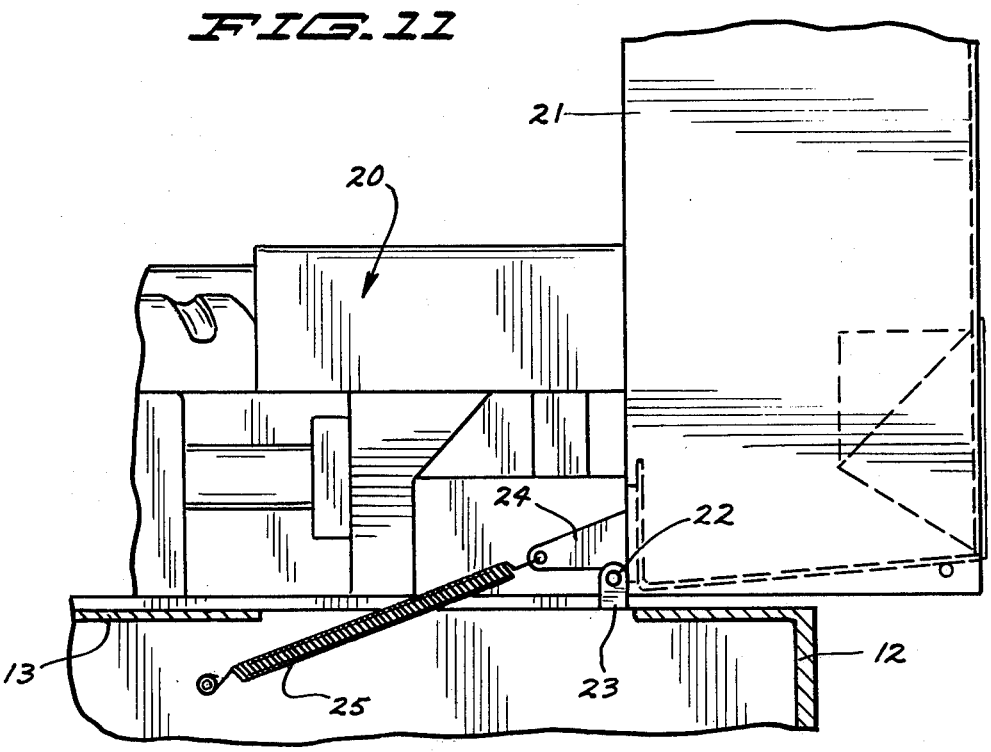
FIG. 12
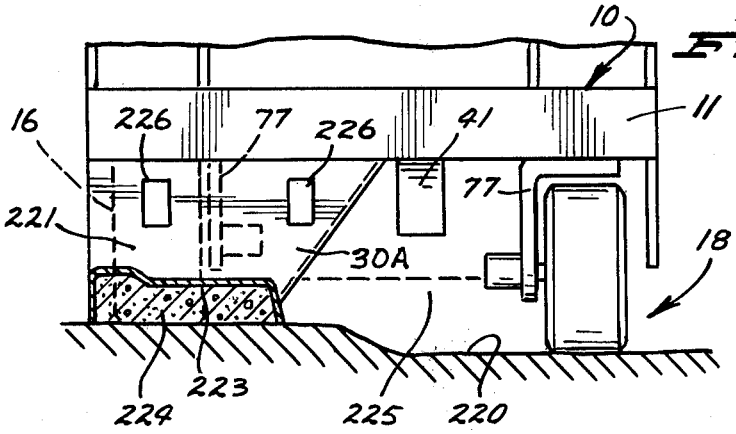
FIG. 10
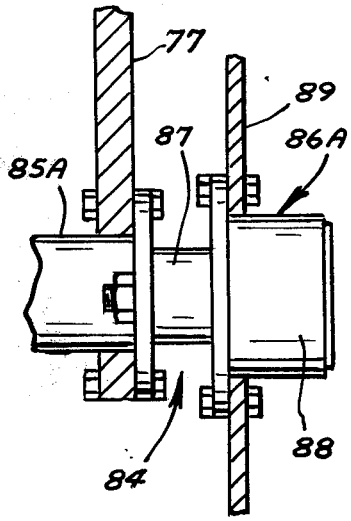
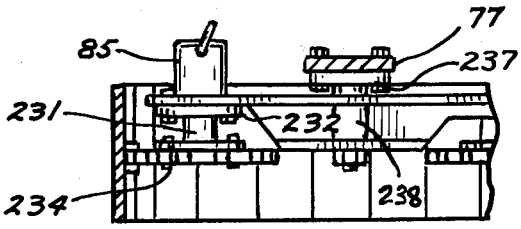
FIG. 14
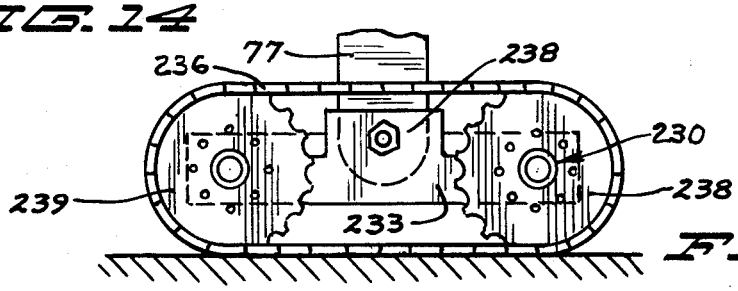
FIG. 13

SLIP FROM PAVING MACHINE

BACKGROUND OF THE INVENTION

1. Field of the Invention.

The present invention relates to self-propelled slip form paving machines.

2. Prior Art.

The prior art, slip form paving machines of various kinds have been developed. For example, U.S. Pat. No. 3,223,006 shows a machine for forming intergal sidewalks and curbs which uses a slip form for the formation of these sidewalks and curbs. Other apparatus in the art is exemplified by a curb forming machine shown in the patent to C. Jennings, U.S. Pat. No. 3,053,156 which has a pair of wheels at the rear thereof that can be laterally moved across the width of the machine for accommodating different form locations and cross section shapes.

Also, automatic controls for operating various grading and paving machines are known, and these controls have been utilized for following a string line or reference level line. Two patents relating to automatic steering and automatic control apparatus issued to Honeywell, Inc., Minneapolis, Minnesota are U.S. Pat. No's. 3,210,710 and 3,258,082.

Further there are paving machines on the market which incorporate vertically adjustable frames for forming concrete members at different heights, for example highway median barrier walls or curbs and gutters. Such machines do include drive wheels which are individually powered from hydraulic motors, and which are mounted on single hinged arms for the raising and lowering of the frame. These swinging arms are relatively long and require extremely heavy members to withstand the loads involved. The steering axis of the wheel on the arms also changes from the vertical as the frame is lifted.

In other paving machines, at least four wheels are used for supporting the machine, and the wheels are mounted on transversely adjustable members so that the positioning of the wheels is changed when different forms are used.

SUMMARY OF THE INVENTION

The present invention relates to a slip form paving machine which utilizes a basic frame having an outer periphery, and within which periphery all of the working components may be stored. The frame member is mounted onto three support members, such as wheel assemblies and each of the wheel assemblies is individually powered and steered. The wheel assemblies are mounted to the frame through parallel linkage means so that as the frame is raised and lowered through the parallel linkages, the steering axis of each of the wheels will remain properly oriented for easy and accurate steering control regardless of the height of the frame relative to the wheels. The parallel linkage members thus permit a substantial height change using a compact linkage without adversely affecting the machine operation and control.

The wheels are positioned so that adjacent the front of the frame there is one wheel close to each lateral side, and there is only one wheel near the rear of the frame. As shown the rear wheel is aligned in longitudinal direction with one of the front wheels. Thus, the front wheel on the opposite side of the frame from the rear wheel can be utilized for slope control and can be operated so that it runs on a different level than the other two wheels if desired. The slope of the machine can be adjusted by changing the setting of the front wheel through its parallel linkage.

The steering is controlled by cylinders which are servo controlled. Feedback sensors are used so that the steering is accurate and precise. In addition, both of the front wheels are steered or operated simultaneously by series connected cylinders, and sensor means are provided for insuring that both of these wheels will remain parallel to each other regardless of leakage in the front steering cylinders.

The engine or power source and other heavy components are positioned to balance the machine so that it is stable on the three wheel support.

In the machine of the present invention, a load conveyor is provided on the frame, and this load conveyor is mounted for side to side movement with respect to the frame longitudinal axis. Movement of the load conveyor is controlled with hydraulic cylinders and can be retracted completely within the periphery of the frame when it is not in use, and can be extended outwardly to a position where it can easily be loaded with concrete from a mixer truck or the like. Further, the height of the conveyor can be adjusted by controlling the cylinders which in turn control the position of the conveyor on a cam type track on which the auger is mounted.

The load conveyor construction comprises a screw conveyor or auger having a framework with a flexible conveyor belt member used as the auger trough. The conveyor belt is a heavy duty, rubberized belt that is stretched taut against the screw conveyor flights during assembly and held in the framework. The screw conveyor edges run against the conveyor belt. The flexible trough will give and move slightly to accommodate irregularities. The concrete or paving material being poured will be positively moved by the screw conveyor from the input end of the auger trough to the discharge end.

The slip forms used with the frame can vary in size and in cross sectional shape depending on what type of concrete member is to be made, but each of the forms has a hopper at its forward or leading end into which the load auger will deposite the concrete. The hopper is provided with vibrators, which are commonly used for insuring that the concrete will be moved into the slip form, and thus as the machine moves forwardly it leaves the formed concrete slab or barrier behind the machine. The machine permits a continuous process of forming curbs, sidewalks, gutters, barriers or the like and the forward speed of the machine can be regulated to meet existing conditions.

The construction permits mounting all necessary components within a standard width frame. Some of the frame members comprise walls of an enclosed water tank used for cleanup water, and also the fuel tank. The fuel tank and water tank are positioned so that the weight of the water and fuel held therein provide counterweight to prevent the machine from being lifted from upward pressure of the forming operation when the concrete is being formed.

A single engine operates the hydraulic pumps, and an electrical generator used for power for the servo controls. The engine and power components are mounted under a single hood unit or shroud, that can be pivoted out of the way for ease of service. The shroud also carries the operator console or control section. The control console is mounted so that it too can be retracted into the shroud when not in use and locked in place for security.

The operator's platform is located so that a clear view of the incoming concrete, the load auger for the concrete, and the slip form, as well as any string or guide line that is being used can be observed easily. Portions of the deck on the frame are covered with suitable expanded metal or similiar screening so that the operator can see the slip form and concrete but yet can walk across the areas.

The positioning of the wheels on the frame permits the pouring of up to a 6½ foot width slab using a frame that is only 8 feet wide, and doing this without any modifications to the frame.

Therefore, it is an ojbect of the present invention to accomplish the purpose of having a compact slip form paving machine that will accommodate a wide variety of widths and heights of slip forms within a standard frame size. It is a further object to provide a slip form paving machine frame that is mounted on three wheels which are easily vertically adjusted and which provide for precise steering control for the unit. It is a further object to present a unique load conveyor construction for use with various types of forms. Other and further objects of this invention will be apparent as the description proceeds.

BRIEF DESCRIPTION OF THE DRAWINGS

FIG. 4 is a sectional view taken as on line 4—4 in FIG. 3;

FIG. 6 is a view taken generally along the same line as FIG. 5 with the load conveyor in a working position;

FIg. 8 is a fragmentary enlarged side view of the lower portion of the wheel support assembly showing the parallel support links and the steering mechanism in greater detail;

FIG. 9 is a bottom view of the device of FIG. 8 with the mounting linkage in a fully retracted (lowered) position and taken along line 9—9 in FIG. 8;

FIg. 10 is a fragmentary vertical sectional view of a typical wheel mounting and power drive;

FIG. 11 is a fragmentary sectional view of the forward portion of the frame and showing the hood in an open position;

FIG. 12 is a fragmentary rear view of the machine in a lowered position and showing it with a modified slip form in use;

FIG. 13 is a schematic side view of an alternate support and propelling means for the machine comprising a crawler tread;

FIG. 14 is a section view of the mounting hub for the device of FIG. 13.

DESCRIPTION OF THE PREFERRED EMBODIMENT

Figure 1:
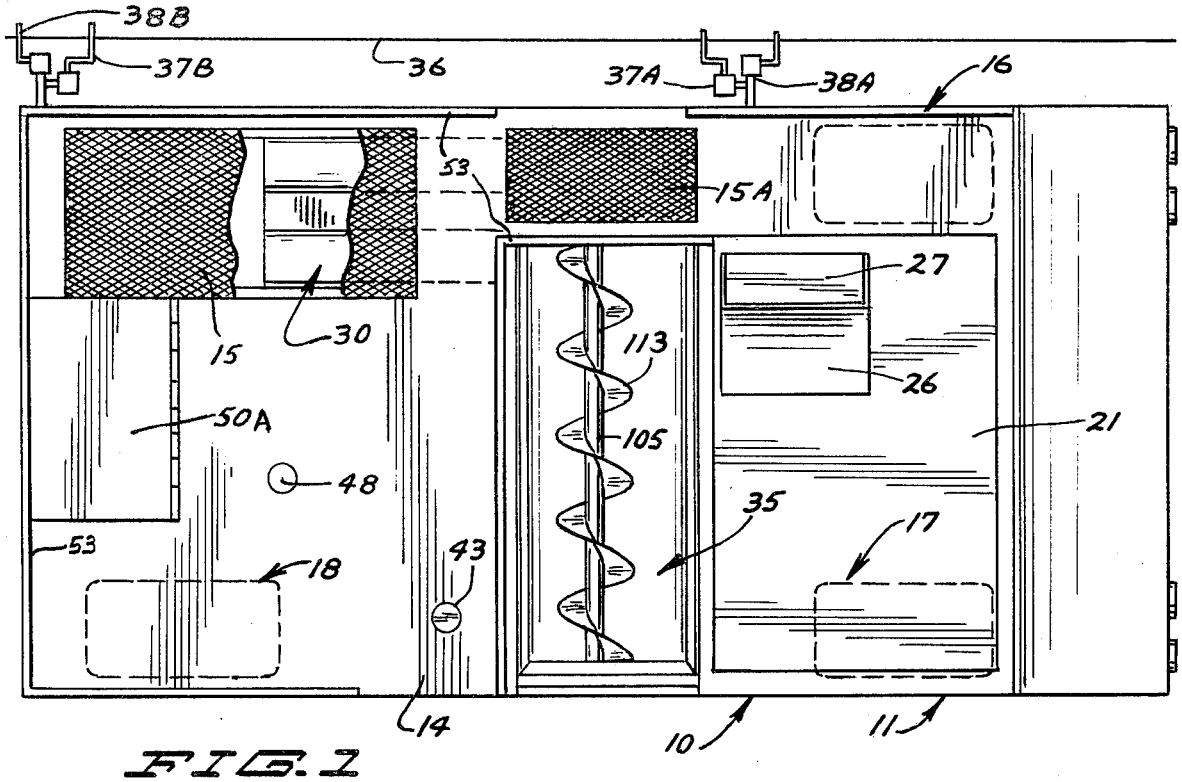
FIG. 1 is a top plan view of a slip form paver made according to the present invention.

A paving machine illustrated generally at 10 includes a main frame 11, that is made up of outer side longitudinal extending members 12, 12 (see also FIG. 3) and cross members 13 at the ends thereof. Other suitable cross members are provided as necessary for frame strength. As shown in FIG. 1, the frame supports a deck plate 14, and in certain places has support mesh or screen 15 and 15A, which may be expanded metal that permits the operator of the machine to look at components of the machine underneath such sections.

The frame 11 is supported by three wheels, and these are represented by a first front wheel assembly 16, a second front wheel assembly 17, and a rear wheel assembly 18 which are merely illustrated in dotted lines in FIG. 1. Each of these wheel assemblies is mounted to the frame in substantially identical manner using parallel linkages. The same numbers will be utilized throughout for the description of the mounting linkages for a simplified explanation, although the plates that are mounted to the frame may be somewhat different.

A diesel engine 20 is mounted on the frame (FIG. 11) and a hood assembly illustrated generally at 21 is pivotally mounted as at 22 (again FIG. 11) from a suitable bracket 23 on the frame and a bracket 24 on the hood. A spring 25 is connected so that the hood can be tilted to its open position as shown in FIG. 11, or to its position shown in FIGS. 1 and 2 covering the engine 20. The hood assembly is a single, easy to raise unit, that can be moved out of its normal covering position for complete service of the engine 20, and other power components which would include the hydraulic pumps and an electrical generator for providing power for the servo controls and for the solenoid operated valves. All of the power unit components are mounted under one hood and the hood can be pivoted to provide complete access to the power components.

Figure 2:
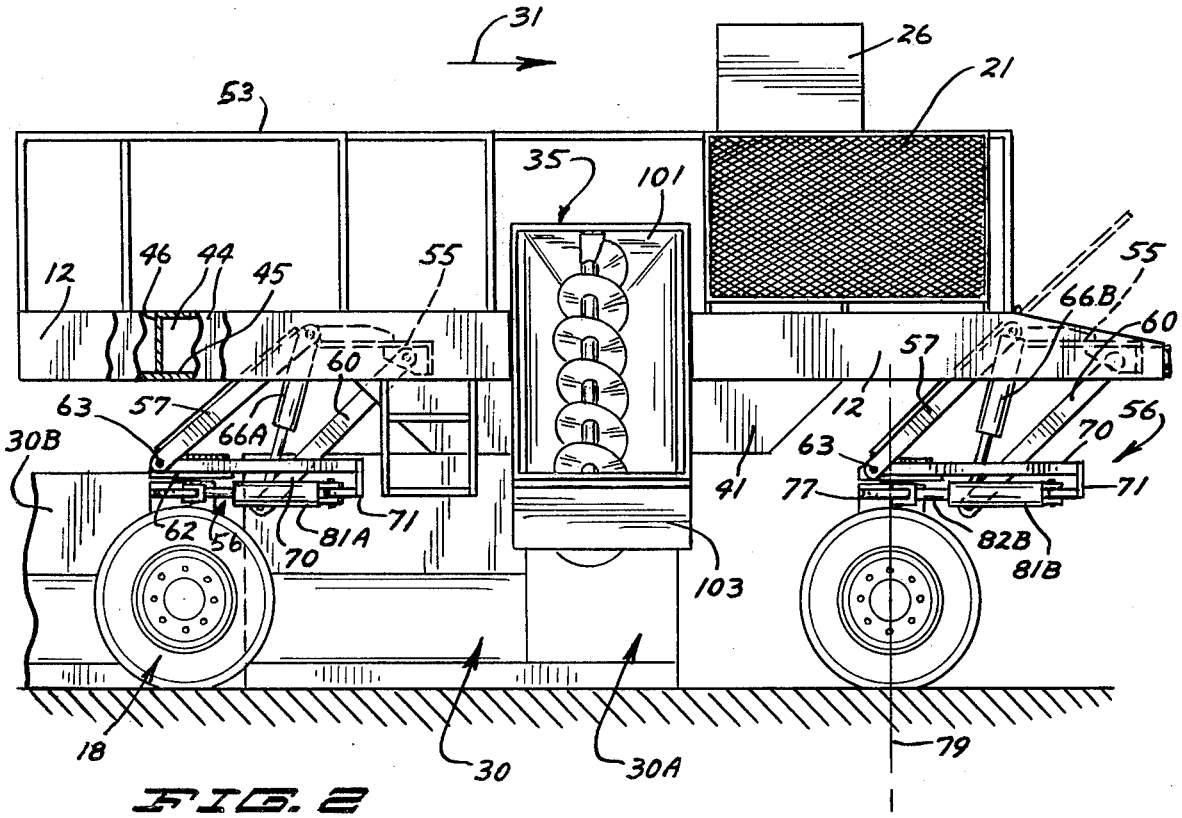
FIG. 2 is a side elevational view of the device of FIG. 1 showing an auger in a working position, and the frame raised for pouring a relatively high concrete member.

The hood 21 also has an operator's console 26 mounted thereon, and the individual control elements, such as toggle switches or the like are mounted on the panel 27. The control console 26 is pivotally mounted to the hood so that the entire control console 26 can pivot to position where the outer wall of the console is flush with the top wall of the hood 21, and the unit can be securely locked in place for security reasons as shown in FIG. 11. As shown in FIG. 2, the end of hood 21 is screened for cooling air intake. Air outlets may also be provided in the hood.

In operation, a slip form indicated generally at 30 of a desired configuration (as shown in FIGS. 1 and 2 it is for pouring a high median barrier) is mounted to suitable brackets in position underneath the frame 11, and is held securely in place. As the machine is powered for forward movement as indicated by the arrow 31, and the concrete or other paving material is supplied to the hopper 30A (see FIG. 6) of slip form 30, a median barrier or other member indicated at 30B is molded or formed. The use of slip forms in mobile machines is quite well known, so the slip forms are shown only schematically, for purposes of illustration.

Paving material such as concrete is loaded into the slip form 30 through an auger or screw conveyor illustrated generally at 35, forming a load conveyor, which has a first end positioned to receive the concrete or paving material from a truck or mixer and convey it to a discharge end of the conveyor and then into the hopper on the slip form. As the hopper 30A is filled and the machine moves forwardly, the slip form will cause the concrete to be molded or formed into its desired shape. The slip forms extend rearwardly from the load auger assembly 35, and the screens 15 and 15A shown in FIG. 1 permits observing the operation of the form to make sure that there is plenty of concrete in the hopper and that the barrier or other concrete member being formed is properly formed.

A string or reference line 36, is supported adjacent to the location where the barrier or concrete curb and gutter is to be poured is shown. The string line 36 is set to a desired reference level or position. The controls will be shown only schematically because the sensors, servo valves, and servo valve controls are mostly purchased components. Suitable sensors such as a front height sensor 37A and a rear height sensor 37B, and a front steering sensor 38A and a rear steering sensor 38B can be adjustably mounted on the frame of the paving machine. These sensors 37A and B and 38A and B have wands that engage the string line 36 and provide signals to the various controls including servo valves and servo amplifiers to automatically steer the slip form paving machine, and also to control the elevation of the machine relative to the line 36. There also may be leveling sensors to keep the machine level in both transverse and longitudinal directions. These sensors are shown only schematically for reference, and the sensors, and servo valves and controls are all products of Honeywell, Inc., Minneapolis, Minnesota, and are commonly used at the present time on mobile earth working and paving machines.

It should be noted that the control console 26 is mounted in a position on the hood so that an operator standing or seated and facing the panel 27 also has a clear view of all working components including the string line, sensor, load auger, forms and the areas ahead and to the rear of the machine.

Figure 3:
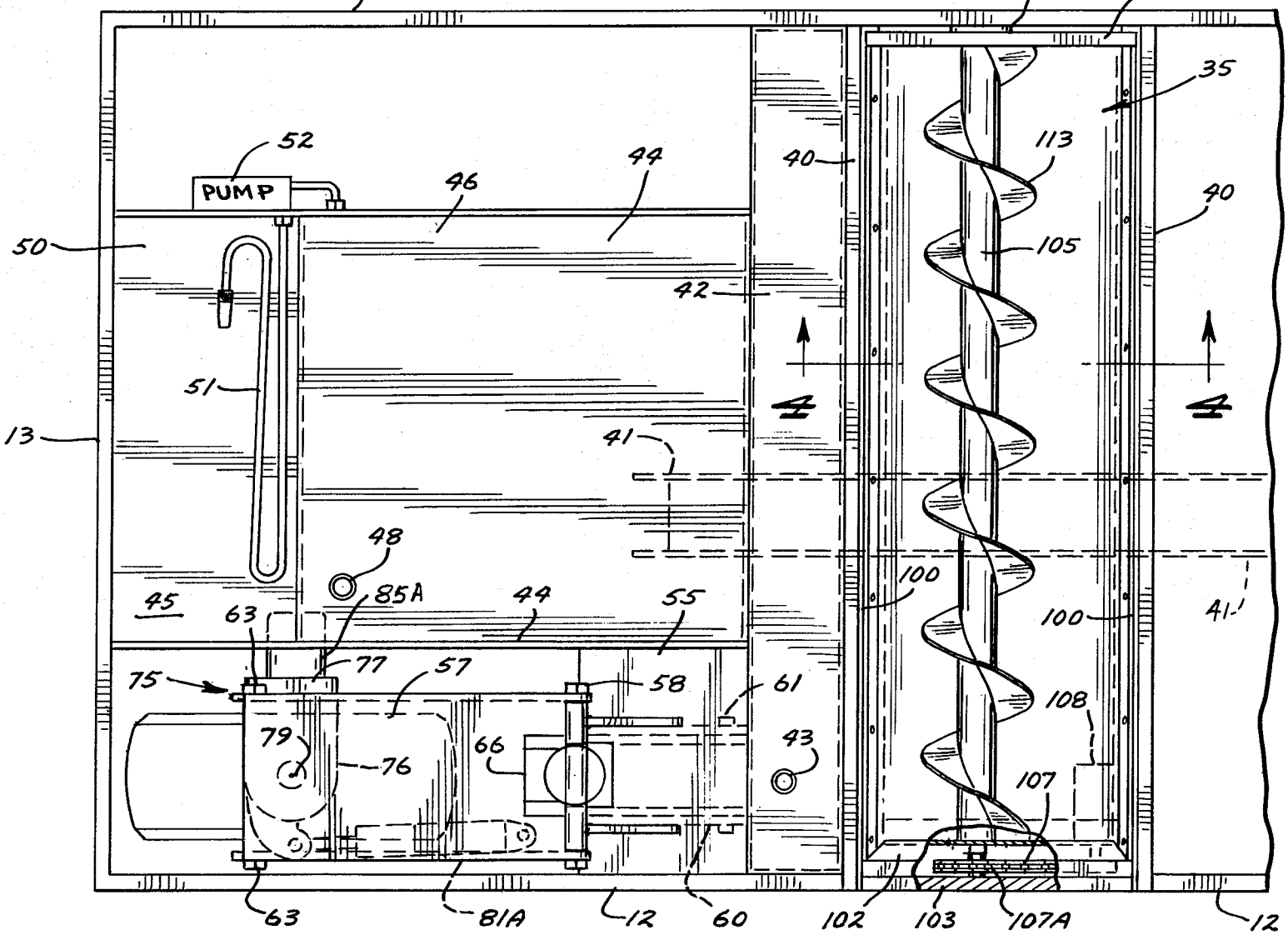
FIG. 3 is a fragmentary top plan view of the frame portion of the device of FIG. 1 with the upper deck broken away to show a typical mounting of one of the support wheels.

Referring specifically to FIG. 3, a showing is made of the unitary frame construction. The load conveyor assembly 35, as can be seen in mounted between a pair of laterally extending heavy guide plates 40, 40 which are attached to one longitudinal frame member 12 at first ends, and define a space between front and rear longitudinal members 12 at the opposite ends thereof. The plates 40, 40 are attached to the front and rear frame members, and a bridge support indicated generally at 41 is used underneath the frame to tie across the space between plates 40, 40. The bridge extends under the load conveyor assembly 35. The plates 40, 40 that are the guide plates for the auger type load conveyor assembly 35 also form structural frame members. A fuel tank assembly 42 is securely welded to the rearward plate 40 and extends between the side members 12, 12. The fuel tank walls extend the full vertical depth of the frame members 12, and the walls are sufficiently thick so that the tank walls form integral load carrying structural support members as well as containing the necessary fuel. A filler neck and cap 43 is provided for the fuel tank, and the cap is accessible above the deck plate 14 of the frame of the slip form paver. The deck plate is removed in FIG. 3. A U-shaped member having a pair of longitudinally extending side plates of legs 44, 44 is welded between the rear cross frame member 13 and the rear wall of the fuel tank 42. The U-shaped member has a bottom plate or wall 45 joined to the legs 44. Above the bottom plate 45 a water tank is formed by an inverted U or inverted channel shaped wall member that has a top wall spaced from and parallel to the wall 45, and end walls extending down to the wall 45. These walls are all welded together so that the bottom wall 45 extends underneath the inverted U-shape member 46, to form the bottom of the water tank, and the side plates 44, 44 form the sides of the water tank. The top and ends of the water tank are formed by the inverted U-shaped member 46. The walls of member 46 and 45 can also be seen in FIG. 2 where parts are broken away to show the construction of the water tank. The break away in FIG. 2 is a double break away showing both the walls 44 and the interior of the water tank.

A filler neck 48 is provided for the water tank, and this also is accessible from above the deck plate of the machine. Thus the water tank and the fuel tank both form integral load carrying structural frame members. The water tank is positioned to the rear of the load conveyor, and almost directly above the slip form. Water in the tank adds weight, and forms a counterweight to hold the machine down when it is being used. There is a substantial upward force on the slip form as the machine is in operation.

To the rear of the water tank, and between the side plates 44, 44, there is a storage compartment 50 formed in which water hoses 51 can be stored. A suitable water pump 52 can be mounted to the exterior of one side plate 44 above the slip form. The open area of the frame where pump 52 is located is visible through the mesh or grate section 15 on the platform of the machine so the operator can see the form and the formed member. A suitable hinged cover 50A can be provided over the compartment 50, as indicated in FIG. 1. Suitable safety railings 53 may be provided on the machine and also adjacent the load auger assembly 35. These railings are removable, and one railing must be removed to open the hood 21.

Now, referring specifically to FIGS. 2, 3, 8 and 9, a typical frame to wheel support linkage is shown. Because the support linkages for all ground engaging-propelling members operate in the same manner they will be referred to by the same numbers, except for the steering and lift cylinders, the drive motors and gear reduction units which will be individually referenced, using the same number but a separate letter designation.

The detail shown is for the rear wheel assembly 18, and this again is only a typical showing. Each of the wheel assemblies includes a support or base plate 55, that is welded into the frame 11 of the machine. As shown, in FIG. 3, the base plate 55 for the rear wheel assembly 18 is welded between one of the longitudinal members 44 that forms part of the water tank, and the outer side frame member 12, and also is welded to the fuel tank 42 for secure fastening. The support plates 55 include suitable brackets for pivotally mounting a parallel linkage illustrated generally at 56. The parallel linkage includes a first leg or link 57 pivotally mounted at a first end to ears on the plate 55 with a pivot bolt 58. The first leg 57 as shown is relatively wide in transverse direction. The upper or first leg 57 is formed as a wide channel, having side members attached to a cross plate. A second leg or link 60 of the parallel linkage assembly 56 is pivotally mounted to ears on the lower side of the plate 55, with a pivot bolt 61 (see FIG. 9). The second ends of the legs 57 and 60 are each pivotally mouted at spaced locations to a steering caster support bracket illustrated generally at 62. The side members of leg 57 straddle the sides of bracket 62, and suitable cap screws 63 are used on opposite sides to pivotally mount this end of leg 57 to the bracket 62. The bracket 62 has a pair of depending spaced lugs 63, 63 which are spaced from the pivot cap screws 63. The second leg 60 also has spaced apart side members that are pivotally mounted on a bolt 64 that passes through provided openings in the side members of the leg 60 and through the ears or lugs 63 (as well as through a rod end for the height control cylinder as will be explained).

Thus, the support bracket 62 is pivoted to both of the legs 57 and 60, and the legs 57 and 60 are also pivoted on their opposite ends to the support plate 55, so that the two legs 57 and 60 together with their supporting brackets form a parallel linkage assembly.

Movement of this parallel linkage assembly comprising first and second legs 57 and 60, and the bracket 62 is controlled by the use of a double acting hydraulic cylinder 66A for the rear wheel (66B is for the right front and 66C for the left front wheels) that is pivotally mounted at its base end to the bolt 58. The first leg 57 has a recess or notch of sufficient size to provide clearance for this cylinder 66A, as does the plate 55. The hydraulic cylinder 66A has a rod that has a rod end member 65 pivotally mounted on the pivot bolt 64 that is used for pivotally mounting the second end of the second leg 60 to the brackets 62. The rod end 65 can be seen in FIG. 9, positioned between the ears 63, 63. thus, when the cylinder 66A is extended and retracted, the bracket 62 will be moved relative to the plate 55 and thus the machine frame 11, but such movement will be constrained by the pivotal mountings of the legs 57 and 60. The bracket 62 will always remain parallel to its original position and thus oriented properly throughout its travel as controlled by cylinder 66A.

The bracket 62 includes a steering cylinder support arm indicated at 70 that is welded to the main part of the bracket and moves therewith, but which extends forwardly from the main part of the bracket. The cylinder support 70 has a tongue 71 thereon, which is used for supporting a steering cylinder.

The bracket 62 also includes a support bracket for the steering caster supporting each of the individual wheels. As can be seen, a caster assembly illustrated generally at 75 has a horizontal support plate 76, and a vertical wheel support member or side plate 77. the caster assembly forms an inverted "L" shaped wheel support, and the horizontal member 76 lies parallel to the bracket 62 and is pivotally mounted to this bracket with a suitable king pin 78. Suitable thrust bearings are provided between the horizontal member 76 and the bracket 62 so that the loads supported by the wheel and caster assembly are carried to the bracket 62 and through the linkage and cylinder 66 to the frame. The casters are rotatable about the upright steering axis indicated at 79, which is the axis of the king pin 78. The steering axis is oriented to be a vertical axis passing through the rotational axis of the corresponding wheel. The axis 79 is centered in side to side direction on the legs 57 and 60. The horizontal plate 76 of the caster assembly 75 has an ear or lug 80 fixed thereto and extending laterally outwardly therefrom on an opposite side of the plate 76 from the side member or leg 77. The ear 80 forms a lever arm for controlling movement of the caster assembly about the pivot axis 79. The ear 80 of each of the caster assemblies has the respective steering cylinder attached thereto. The steering cylinder, indicated at 81A for the rear wheel, is a double acting hydraulic cylinder and has a rod 82A that is extendable and retractable. The base of the cylinder 81A is attached to the support ear 71. The steering cylinder for the wheel assembly 17 is indicated at 81B, and the steering cylinder for the wheel assembly 16 is indicated at 81C. The cylinders 81B and 81C operate in series from a common valve, and cylinder 81A may be operated separately.

Upon extension or retraction of the rod from the center position as shown in FIG. 9, the respective caster assembly 75 will be rotated about the steering axis 79 and this will of course change the angle of the caster assembly about the vertical axis so that the paving machine will be steered. It should also be noted that the front wheel assemblies and the rear wheel assembly rotate in opposite direction during normal steering. For example, if the front wheels turn in counterclockwise direction the rear wheel will go clockwise.

Now, referring specifically to FIG. 10 a typical caster assembly 75 is shown fragmentarily in section to illustrate the mounting of the drive components. As shown, the downwardly depending leg or side plate 77 is used for mounting the drive assembly indicated generally at 84.

The individual wheels are each powered with separate hydraulic motors indicated at 85A (85B and 85C are motors for the front wheels). These hydraulic motors are mounted onto and drive a planetary drive hub, known as a "Torque Hub" made by Fairfield Manufacturing Company and indicated generally at 86A. This torque hub 86A is a planetary gear drive which has suitable planetary gears to get the proper reduction between the input and the output speeds. This torque hub or planetary drive hub 86A has a main or stationary member 87 directly fastened to the side leg 77 of the caster assembly 75, with suitable bolts 90, which hold the flange of hub 87 onto the leg 77. The torque hub 86A includes an output hub 88 which is rotatably mounted on main hub 87 and is rotationally driven through internal gears by the output shaft of motor 85A. The output hub 88 is thus rotationally driven at a reduced speed (the ratio preferred is 68:1) while the mounting hub 87 is held from rotation and carries supported load between the leg 77 and the outer rotating hub 88. The hub 88 has a flange used for mounting the wheel 89 which is shown only schematically. The wheel is held with lug bolts and nuts.

One of the features of the present device is that the planetary drive hub, and wheel and tire can be quickly removed by removing the bolts 90 so that different drives can be replaced quickly. The motor 85A would be used on the new drive unit. For example a crawler track unit may be used as will be explained in connection with FIGS. 13 and 14.

The construction of the load conveyor assembly is illustrated generally in FIGS. 3, 4, 5, 6 and 7. It was previously mentioned that the load conveyor assembly 35 comprised a framework that supported the screw conveyor or auger and trough for lateral movement between heavy guide plates 40, 40. Referring now specifically to FIGS. 3 and 4, it can be seen that the conveyor frame comprises a pair of side members 100, 100, which are spaced apart and which are positioned adjacent to the guide plates 40, 40. These vertical side plates 100 are fastened to end frames 101 and 103 at opposite ends of the conveyor. The frame 103 has an outer end bearing support member (FIG. 3) and a shroud 102 that is spaced inwardly from the outer end member. The end member of frame 103 aligns with the front and rear side frame member 12 for a smooth appearance when the load auger is retracted as shown in FIG. 3. The outer end bearing support member of frame 103 mounts a bearing that supports a shaft of a screw conveyor illustrated generally at 105. The opposite end of the shaft for the screw conveyor is mounted in a suitable bearing mounted on a bearing hanger 106 that is attached to the cross frame 101.

The screw conveyor assembly 105 is made up of individual cast sections for the flighting which are mounted onto a central member. The screw conveyor can be any other desired configuration, but it does have a drive shaft protruding from member 105 which terminates at the outer member of frame 103. A sprocket 107A is drivably mounted on the conveyor shaft and a chain 107 is used to drive the sprocket 107A from a sprocket on the output shaft of a hydraulic motor illustrated in dotted lines at 108. The motor 108 will be operated as desired to rotate the screw conveyor 105 and move material along the load conveyor assembly.

The side members 100, 100 of the frame for the conveyor have angled flange plates 111, 111 mounted thereon, respectively, and these plates are inclined at a desired angle with respect to the side plates 100, 100 and are used for attachment of a length of conveyor belting which forms the auger trough 112. The belting is stretched taut against the screw flights 113 of the auger or screw conveyor assembly 105. The flexible belting forming trough 112 is attached to the flanges 11 with a suitable holding strip 114 and cap screws that are threaded into the flanges 111.

The conveyor belting thus forms a flexible wall trough for the screw conveyor and the flights 113 engage the innersurface of the flexible belting forming the auger trough 112 so that when the screw conveyor 105 is rotated material in the trough 112 will be moved along the trough, and the flexible belt permits flexibility and some deforming of the trough as the material is conveyed. The belting insures that the screw conveyor 105 will convey the material that is deposited in the trough in a positive manner from the load end (adjacent frame 103) to its discharge end.

It should be noted that the cross frame member 101, as shown in FIG. 4 is spaced above the lower portion of the trough 112, so that material can be discharged out underneath the cross frame member 101 as the screw conveyor is powered.

Figure 5:
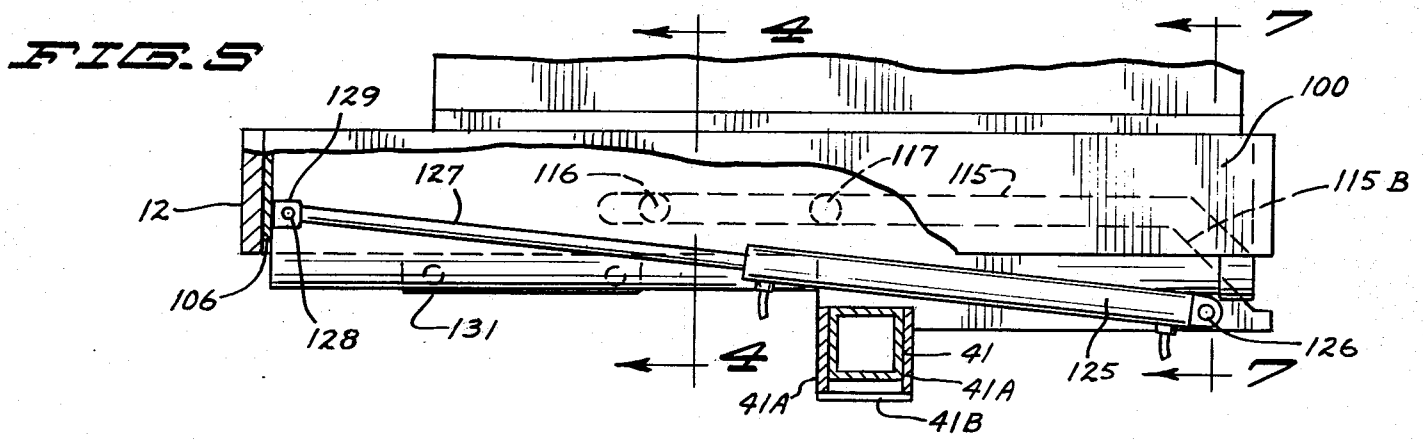
FIG. 5 is a side sectional view of a load conveyor assembly taken generally along the line 5—5 in FIG. 7, with the load conveyor in a retracted or transport position.
Figure 7:
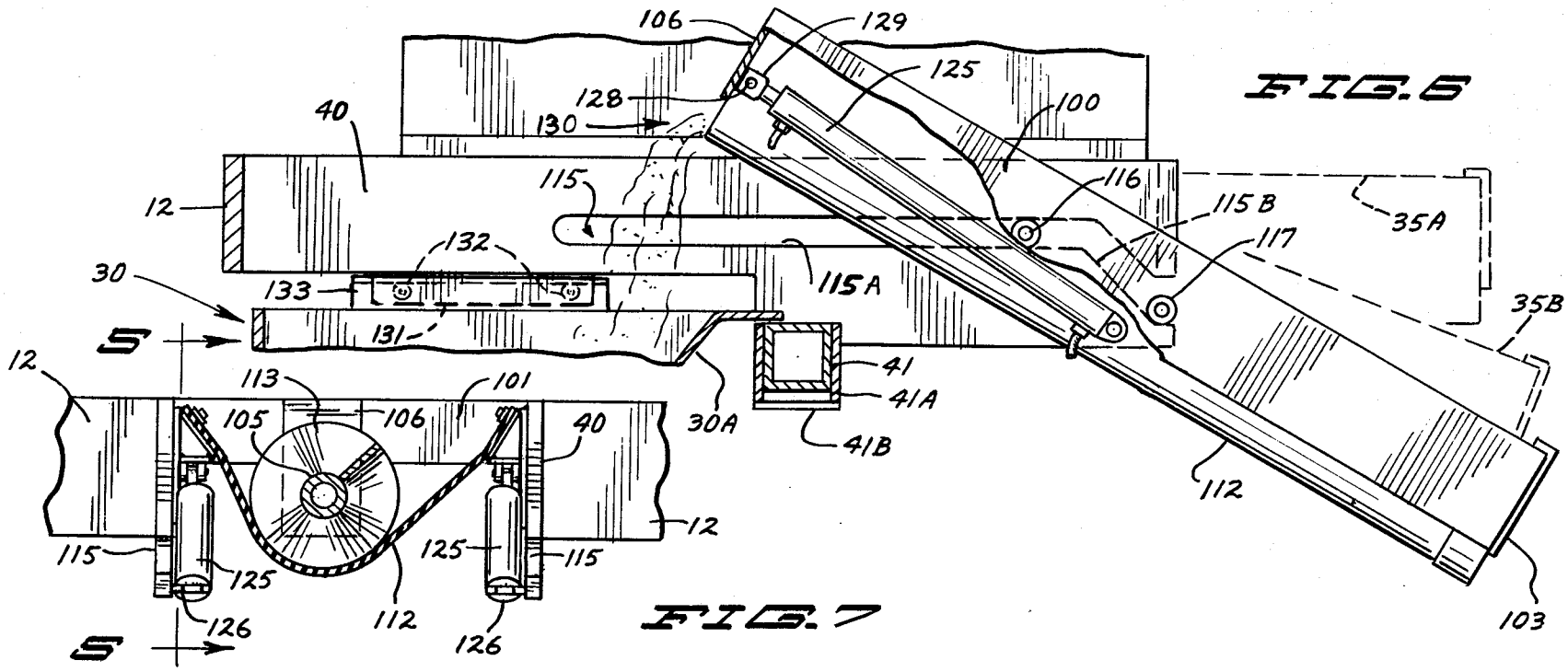
FIG. 7 is an end view of the load conveyor taken generally along the line 7—7 in FIG. 5.

The side guide members 40 which extend transversely of the machine, are provided with elongated cam slots 115, on each side of the unit, and these slots 115, as shown have a generally horizontal section 115A, and an inclined section 115B which is adjacent to the outer frame member 12 at the loading end of the load conveyor. The vertical side plates 100 of the frame each have two cam rollers indicated at 116 and 117, respectively, mounted thereon. These cam rollers 116 and 117 are shown in FIGS. 5 and 6, and are of size to fit within the respective slots 115 and serve as carriages operating in the slots 115 which form tracks for these roller carriages.

The load conveyor assembly 35 can be moved from its transport or storage position wherein it is completely stored within the confines of the frame 11, as shown in FIGS. 1 and 3, to a loading position shown in FIGS. 2 and 6 through the use of a pair of double acting hydraulic cylinders illustrated generally at 125, positioned on opposite sides of the load conveyor frame and attached to the respective guide members 40. The cylinders 125 have base ends attached as at 126 on suitable pins fixed to the respective side guide plates 40, and have extendable and retractable rods 127 that have rod ends pivotally attached as at 128 to suitable brackets 129 which are attached to the side plates 100 of the auger assembly frame.

When the rods 127 are fully extended from the cylinders 125, the auger assembly is all the way retracted, with the member 103 flush with the side of the frame 11. The load conveyor assembly is then in its storage position. However, upon retraction of the cylinders 125 through the operation of suitable valves, the load conveyor assembly 35 will be moved between the guide members 40, 40 on roller carriages 116 and 117 which roll in the slots 115.

The load conveyor assembly will first be moved substantially horizontally laterally outwardly, to a position generally as shown in dotted lines at 35A in FIG. 6. When the rollers 117 start to move down the cam portions 115B of slots 115, the outer or loading end of the load conveyor assembly will start to move downwardly, and the inner or discharge end will start to move upwardly. The rollers 116 will still be in the horizontal slot portions 115A.

Before the rollers 117 reach the bottom of the slot portions 115B, the conveyor can be stopped by holding the cylinders 125 in position, for example, as shown at 35B in FIG. 6 which would be an intermediate loading position. The end of the conveyor is raised for ease of unloading from a particular type of vehicle or to accommodate irregular or sloping terrain. In its full extended position the load conveyor would be in position shown in solid lines in FIG. 6 with the rollers 117 resting in the portion 115C of the slots 115, and the cylinders 125 fully retracted. Then, any paving material, such as concrete, deposited in the load conveyor with the motor 108 running would be conveyed upwardly toward the discharge end of the screw conveyor or auger which is indicated at 130. The material then would be discharged from this discharge end underneath the cross frame member 101 and drop into the hopper 30A of the slip form shown fragmentarily in FIG. 6.

Suitable slip form supports are shown at 131, and include a pair of support rollers 132, (see also FIG. 4) which are made to support a flange that is illustrated at 133 attached to the slip form illustrated generally at 30. The slip form 30 has a hopper portion 30A that is underneath the discharge end 130 of the conveyor. The paving material will drop into the hopper 30A and will move into the slip form in a known manner. Suitable vibrators are placed on the slip form to insure that the concrete or other paving material will move into position and be molded or formed by the form as the paving machine advances.

It should be noted that the bridge or frame support 41 fits into a provided recess in the side plates 40, 40 and is rigidly welded thereto to hold the side plates 40, 40 in position and strengthen the frame. The bridge 41 has a center tube and downwardly depending walls 41A fixed to the tube. The walls 41A are joined with cross members 41B across the bottom edges of the walls. The cross members 41B not only serve to strengthen the bridge, but provide supports for hydraulic hoses and control cables that have to pass across the opening defined by the guide plates 40, 40. The member 41B will support the hoses and the side plates 41A will shield them from damage.

The load conveyor assembly can also include shield panels that extend uprightly from the conveyor frame. These are not shown but can be added if desired.

Referring to FIG. 12, a part schematic rear view of the paving machine made according to the present invention is illustrated with a slip form in place for laying a typical curb and gutter. The machine 10 has the framework as previously described, and as shown, the rear wheel assembly 18 is on a surface indicated at 220 that is offset below, or at a different level than the front wheel assembly illustrated at 16 on the opposite side of the machine. The wheel assembly 17 is the slope control wheel. The wheels can be adjusted by the controls to accommodate this differential in position. Slope sensing mechanism provided maintains the frame at a level position regardless of the fact that the wheels on the right side of the machine for example, the wheel assemblies 17 and 18 are on a different level than the wheel assembly 16. The slip form indicated generally at 221 in FIG. 12 has a hopper portion 30A that is in position to receive the paving material, such as concrete, from the load conveyor shown in the previous form of the invention. The slip form 221 includes a rearwardly extending form member or screed illustrated at 223 that is shaped to provide the desired cross section of a curb and gutter shown at 224 that is to be laid. As shown in dotted lines at 225, the rear portion 223 can be extended sideways or laterally toward the wheel assembly 18 a desired amount so that a wide sidewalk can be laid. It should also be noted that the side of the form 221 is in close proximity to the left side of the machine. Portions of the form may even extend farther to the left than the frame of the paving machine to pour a sidewalk next to a wall or frame. The slip form is behind the front wheels. No wheels are placed between the left side edge of the machine and the slip form. All of the space under the frame from the left side laterally to the rear wheel assembly 18 is available for mounting forms. Thus the form can be almost as wide as the frame. A 6½ foot wide form can be mounted and used with the standard 8 foot wide frame.

As shown at 226, vibrators can be attached to the slip form hopper as desired for insuring that the paving material, such as concrete, will be moved into the slip form, and into the rearwardly extending section 223 which does the forming. Vibrators can be mounted at any desired location.

Now, referring to FIGS. 13 and 14, an alternate crawler track support and propelling member indicated generally at 230 shown schematically and includes a mounting hub adapted to be mounted onto the leg struts 77 of the casters. The gear hubs 86, which are used for mounting the wheels, are removed from the legs or side plates 77 by removing the cap screws that attach them to the legs, and the hydraulic motors 85 are also removed from the hubs 86. The crawler assemblies 230 have a longitudinal main frame member 233 that has a gear reduction hub 231 (identical to hubs 86) attached thereto at the rear thereof. The stationary portion 232 of the hub 231 is suitably fixed to the frame member 233. The driven member 234 of hub 231 has a crawler track drive sprocket 239 mounted thereon in the same manner as the wheels are mounted on the hubs 86. A front idler sprocket 238 is rotatably mounted on the frame 233 and a crawler track or chain 236 is drivably mounted over the sprockets 238 and 239. The same hydraulic motor 85 used with the corresponding wheel is then mounted on the hub 231 in the same manner as on the 86. By controlling the motor 85 the crawler track can be powered.

The crawler track assembly is attached to the leg strut 77 with a simple adapter plate 237 and a hub bracket 238. A bolt is used to hold the adapter plate 237 to the frame 233 in the desired manner. The adapter plate is then bolted to the leg 77. The rotating or driven member 234 of the hub assembly 231 drives sprocket 239 whenever the motor 85 for that crawler unit is powered. The mountings of the crawler assemblies are centered with the steering axis so each of the crawler assemblies can be steered in the previously described manner.

The crawler track assemblies 236 provide more flotation for paving over sand, for example. Using the same motor 85A to drive the gear reduction hub 231 of the crawler assembly 230, the assemblies can be quickly interchanged with the wheel assemblies and the motor simplifies the driving of the crawler tracks. This interchangeability increases the versatility of the paving machine when additional flotation or traction is desired. The crawler tracks are conventional, but the use of identical mounting flanges for both the wheels and the crawler track frames and use of the same individual power units permits the quick interchange of these two different types of ground propulsion devices.

The controls for the present device utilize substantially standard electro-hydraulic controls including known sensors for slope control, and for the steering and grade control. In the servo system the steering controls have devices for providing feedback signals to the servo mechanism. As shown, in FIGS. 8 and 9, a feedback sensor 140, such as a potentiometer that is rotationally driven is mounted onto a bracket 141, that in turn is attached to the bracket 62 and moves therewith. The output shaft of the feedback sensor 140 has a sprocket thereon which is driven by a chain 142 operating from a sprocket 143 that rotates with and is driven by the king pin 78. In this way, any movement about the steering axis will provide an electrical feedback signal to indicate the position of each of the individual wheels. It is to be understood that the same type of feedback member can be used on each of the wheel assemblies for indicating movement about the axis 79.

Figure 15:
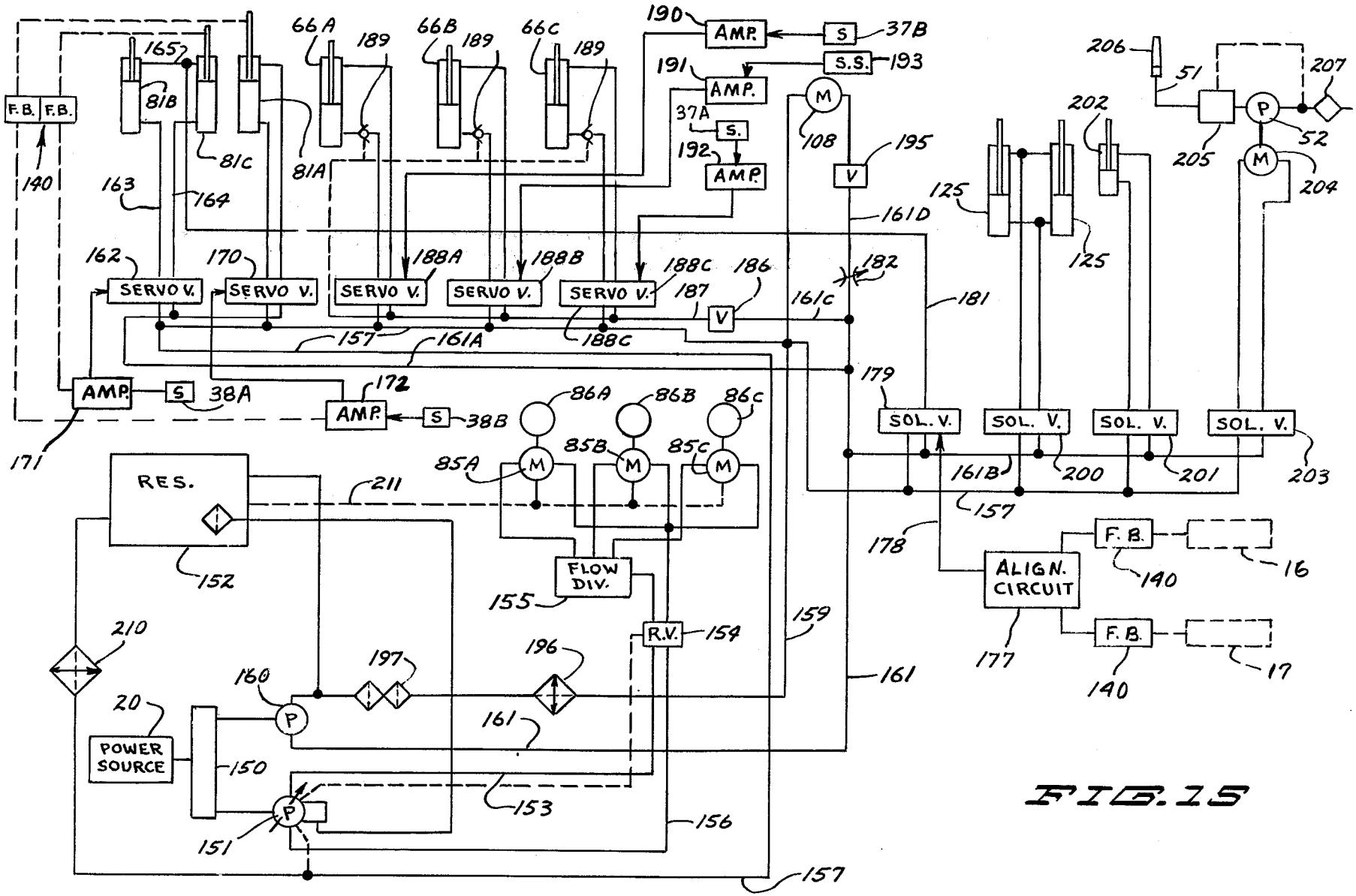
FIG. 15 is a schematic representation of the hydraulic circuitry used on the machine.

Now, referring specifically to FIG. 15, a schematic representation of the hydraulic circuitry is shown. The engine 20 is shown schematically and labeled power source, and this in turn drives a dual pump drive assembly 150 that is a standard gear unit and has two output shafts, one of which drives a first variable displacement pump 151. Such variable displacement pumps are well known, and the output of the pump is proportional to the position of a control element that can be operated manually or automatically. The pump 151 is used for driving the individual propulsion motors. A hydraulic fluid reservoir 152 is provided. The output or pressure line 153 of the pump 151 is connected through a relief valve 154 to a flow divider 155. The flow divider in turn divides the total flow coming from the pump 151 into three output lines, each of which is connected to power the individual motors 85A, 85B and 85C. The return lines from the motors are plumbed together and through relief valve ports and line 156 to the low pressure side of the pump. The pump thus is a closed system with provision for make-up oil if it is necessary. The pump also has internal overpressure passageways leading to a main return line 157 that returns to the reservoir.

The pump 151 can be varied from zero volume on up to full flow by the controls of the pump, which are well known, and this in turn will vary the speed of rotation of the motors 85. As can be seen the motors are coupled to drive the planetary hubs 86A-86C for the wheels and crawler units. By regulating pump output the wheels or crawlers can be driven at an infinitely variable speed depending on the pump setting selected.

Thus the hydraulic motors 85A-85C for the machine drive have the separate pump that is used just for these motors. The flow divider 155 insures that the motors 85A-85C are each driven at the same rate.

The second output of the pump drive 150 drives a pump 160, which has a pressure output line 161 that forms the main pressure output line. The pressure line 161 is connected to a branch line 161A which is connected to the pressure ports of a pair of four-way servo valves 162 and 170. A first servo valve 162 is the servo valve that controls hydraulic fluid flow to both of the steering cylinders 81B and 81C, which are the steering cylinders for the right and left front wheels, respectively. As shown, a line 163 from the servo valve 162 leads to the base of the cylinder 81B, and the line from the rod end of the cylinder 81B is connected by a line 165 to the rod end of the cylinder 81C as shown. The base of the cylinder 81C is connected with the line 164 to the opposite port of the servo valve 162 from line 163, so that when the servo valve is energized or moved in a first direction, hydraulic fluid under pressure from line 161 will flow into line 163, to extend the cylinder 81B, and the oil from the rod end or return side coming from the line 165 will be supplied to retract the cylinder 81C. The oil flowing out of the base end of the cylinder 81C will flow through line 164 back to the servo valve 162 and then to a drain connection leading to the line 157. The cylinders 81B and 81C are thus series connected through the servo valve 162.

The line 161A also is connected to the second servo valve 170 that is connected to operate the steering cylinder 81A for the rear wheel. Valve 162 is controlled by a valve amplifier 171 of conventional design which will operate the servo valve from either a manual switch used for actuating the valve manually or from signals from the sensor 38A operating automatically from the grade line 36. The manual switch inputs are used for manually steering the vehicle. An amplifier 172 is connected to control valve 170 and the amplifier 172 also may have a manual switch for steering manually or may be controlled by sensor 38B operating off the grade line 36. The feedback sensors 140 are shown connected by dotted lines to the rods of the cylinders 81A and 81C. Because the cylinders 81B and 81C are operated simultaneously only one feedback is needed for the controlling amplifier 171. As shown feedback from the left front wheel steered by cylinder 81C is used.

The feedback signals are provided to the respective amplifiers in a known manner to precisely control the position of the steer cylinders. The controls, including the steering sensors and the servo valves are made by Honeywell, Inc., Minneapolis, Minnesota, Their mobile servo valve Model V7058A-1171, used with an amplifier such as their Model No. R7232A and suitable steering sensors such as their Model SB104A can be used. Manual control inputs for controlling the valves of course are well known in the art and are supplied as part of the amplifiers.

The connections of the steering cylinders 81B and 81C, which put the cylinders in series, but reverse acting, (or in other words when one of the cylinders extends, the other retracts), operate satisfactorily if there is no leakage at all from such hydraulic cylinders. Leakage does occur so a make-up or alignment system is utilized to synchronize the front wheels. At the right hand side of FIG. 15 feedback sensors 140 for wheel assemblies 16 and 17 are shown. These wheels are steered by cylinders 81C and 81B, respectively. For the alignment system the feedback sensor for wheel assembly 16, controlled by cylinder 81C has a separate potentiometer to provide a signal separate from the feedback signal provided to amplifier 171. The feedback sensors 140 shown at the right side of FIG. 15 provide electrical signals representative of the steer angle of the wheels controlled by cylinders 81B and 81C. Signals from these sensors 140, are provided to an alignment circuit 177 of suitable design. The circuit 177 can be a null sensing circuit such as a bridge which provides an output when feedback sensors are not of equal setting or the alignment circuit 177 may be a proportional circuit that adjusts the front wheels to positions which are selected ratios to each other, for example in a tight turn the inside wheel on the turn may be held at a different angle than the outside wheel for proper action. Any output from the circuit 177, which occurs when the sensors 140 for the front wheels are not at the desired setting relative to each other is provided through a control line 178 to operate a solenoid valve 179 in accordance with the polarity of the output signal. The circuit 177 can have amplifiers if necessary to drive the valve 179.

The solenoid valve 179 has a pressure port connected to a pressure line 161B that in turn is connected to the pressure line 161 from pump 160. One output port of the solenoid valve 179 is connected through a line 181 to line 165 between cylinders 81B and 81C. The solenoid valve 179 is a four-way closed center, spring detent solenoid valve with one output port blocked. If the output of alignment circuit 177 is a first polarity, the valve 179 will be operated to provide a drain flow from the rod ends of cylinders 81B and 81C through the line 165 and line 181 back to the drain side of valve 179, which is connected to drain line 157. The cylinders 81B and 81C will extend because of flow from the servo valve 162 as will be explained.

When the feedback sensors 140 reach a balanced position which indicates that the front wheels assemblies 16 and 17 are at the desired relative rotational position about their steering axes, the valve 179 will be relaxed to close or block line 181. If there is unbalance of the signals from the feedback sensors connected to the circuit 177 in opposite direction the alignment circuit 177 provides an output along line 178 in opposite polarity or direction and the valve 179 will be also operated in opposite direction. Pressure would then be supplied to the line 181, and thus to the rod ends of the cylinders 81B and 81C causing the rods to retract against the servo valve pressure as will be explained. In this way any wheel alignment errors occasioned by leakage which causes drifting of one of the cylinders 81B or 81C with respect to the other is compensated for. Restrictor orifices are provided in line 181 for control of flow rates.

The servo valve 162 is designed so that when in a neutral position both of the output ports are subjected to pressure because of valve design which provides for a "quiescent flow" from the pressure port to drain. Because the pressure on both output ports is equal normally no flow is provided to load.

In these valves, however, the pressure at the valve ports when the valve is in neutral is less than system pressure because of pressure drops in the valve. The make-up line will either supply full system pressure to line 165 to overcome the neutral pressure at the servo valve acting on the base ends of the cylinders and cause both cylinders to retract, or when line 181 is connected to drain by valve 179, the quiescent flow will act on the base ends of both cylinders 81B and 81C to extend them until valve 179 closes. This quiescent flow feature is described in the Instruction booklet for the Model V7059A valves.

A pressure line 161C from line 161 is connected to an input port of an on-off or two-way valve 186, the output line of which is indicated at 187 and which is connected to the pressure ports of three servo valves 188A, 188B and 188C. These servo valves 188A, 188B and 188C are four-way servo valves, for example Honeywell, Inc. valves Model V7059A-1048, and the output ports of the servo valves are connected to the main lift cylinders 65A, 65B and 65C, respectively. The cylinders 65A-65C are operated to raise, lower and level the machine in accordance with suitable sensors or by manual operation. Pilot operated check valves indicated generally at 189 are provided on each of these cylinders to prevent the machine from settling and to prevent flow out of the base ends of the cylinders until there is pressure on the pressure input line 187 from valve 186 to the servo valves 188. Such check valves also are well known in the art and are thus shown only schematically. When valve 187 is off the cylinders 66A-66C are held in position.

The servo valves 188A-188C are operated from suitable valve amplifiers 190, 191 and 192 respectively. Each of the amplifiers 190, 191 and 192 has a manual switch control for manual operation to raise or lower the frame. The grade sensor 37B also provides an input to amplifier 190 for controlling valve 188A and cylinder 66A automatically from the string line 36. Sensor 37A provides signals to amplifier 192 for controlling the valve 188C and cylinder 66C automatically from line 36. A slope sensor shown schematically at 193 is provided for automatically insuring that the proper slope of the machine frame is maintained. The slope sensor can be an ordinary pendulum or level sensor of usual design also made by Honeywell, Inc. The slope sensor is connected to amplifier 191 and will control valve 188B and cylinder 66B. These controls are conventional controls used commonly in paving machines and earth working machines for slope and height control. The controls also include adjustments for position and sensitivity.

The valve 186 for the lift cylinders can be used for preventing changing of the setting to the cylinders 66A-66C once they have been located in the desired position.

The hydraulic controls also include a valve 195 connected with a line 161D which is connected to the pressure line 161 through a conventional flow control valve 182. The valve 195 is a two way solenoid controlled valve of usual design operating to control flow to the screw conveyor drive motor 108. The valve 195 is merely an on and off valve for such flow. The drive motor has an output side connected to the drain line 157.

The pressure line 161B is also connected to a four way solenoid valve 200, which in turn operates the screw conveyor in-out cylinders 125 in parallel. These cylinders are operated through restrictors in the lines so that the rate of movement of the cylinders is restricted. A solenoid valve 201 may be also connected to the pressure line 161B and drain 157, and operated to control an auxiliary cylinder 202 which can be used for things such as driveway cutter, which is a blocking member that will block out a portion of the curb from being formed in places where a driveway is to be inserted. The driveway cutter would merely block off the curb portion (the upper or raised part of the form shown in FIG. 12). Other auxiliary mechanisms can also be operated by the cylinder 202.

A solenoid valve 203 also connected to pressure line 161B and drain line 157 can be used for driving a hydraulic motor 204 which is used for operating the water pump 52. The water pump 52 can operate through an unloader valve 205 to provide water under pressure to the water hose having a spray nozzle 206 that can be used for clean-up after work is done. Pump 52 can receive water through a filter 207. The unloader valve is a relief vavle for bypass, if the nozzle is turned off.

The controls thus are largely conventional but serve to operate the parallel support linkages for precise control. An all electro-hydraulic control apparatus is provided. Further, an alignment circuit is provided for compensating the front steering cylinders so that they are always parallel to each other in response to electrical signals generated from feedback potentiometers or sensors.

It should also be noted that an additional cooler such as a cooler 210 can be used in the return hydraulic line 157, and the motors 85A-85C can have internal relief valves connected to a drain line 211. The return line 159, leading to pump 160 is connected to line 157. Line 159 has a cooler 196 and filter 197 therein.

The paving machine is compact, easily operated and easily transported. The mounting of the wheels insure proper controllability, and permits maximum utilization of available space for forms and the loading auger, as well as the fuel and clean-up water tanks. A very versatile machine is thus provided.

I claim:

1. A mobile machine for slip form paving using a paving material to form a structure comprising a frame member having a leading end and a trailing end and lateral side edges, said frame member having a load conveyor mounted thereon, and means to mount a slip form on said frame for forming said paving material into the desired structure as the machine is moved forwardly, means mounting said frame for movement along a surface comprising a pair of forward surface engaging members mounted to said frame member adjacent the leading end thereof when moving in normal direction of movement for paving, means mounting said pair of surface engaging members closely adjacent the side edges and within the periphery of said frame member, a single third surface engaging member, means mounting said single surface engaging member with respect to said frame member closely adjacent one side thereof and within the frame periphery and to normally move substantially in the track of one of said forward surface engaging members as the machine moves in said normal direction of movement, and positioned adjacent to the rear of said frame member and laterally displaced from a slip form mounted on said machine, said means to mount a slip form being positioned to trail behind the other of said forward surface engaging members, and power means mounted on said frame for powering said surface engaging members for propelling said machine including an engine positioned adjacent the forward end of said frame member between and at least partially overlying said forward surface engaging members to balance and stablize said machine, said means mounting said surface engaging members including separate movable parallel linkages for each surface engaging member, each separate parallel linkage comprising a pair of links having first ends pivotally mounted with respect to said frame member about axes positioned at fixed locations on said frame member, said links having second ends pivotally mounted to its respective surface engaging member with the links in parallel relationship about axes parallel to the spaced axes, whereby the surface engaging members remain oriented with respect to a vertical plane as the parallel linkages are moved to facilitate steering movement of the surface engaging members.

2. The combination as specified in claim 1 said means mounting said surface engaging members to said frame member comprising means to permit pivoting steering movement of each of said surface engaging members relative to its associated parallel linkage about substantially upright steering axes.

3. The combination as specified in claim 2 and means to power said surface engaging members individually, comprising individual motor means driving each of said surface engaging members.

4. The combination as specified in claim 3 wherein said means mounting said surface engaging members include substantially upright legs, and said surface engaging members each comprise first surface engaging members mounted on one of said legs, removable means to mount each of said surface engaging members to one of said legs including a nonrotatable hub fixed to an associated leg and a second surface engaging member having a hub interchangeable with said nonrotatable hub adapted to be mounted on said associated leg in place of a first surface engaging member.

5. The combination as specified in claim 4, wherein said first surface engaging members comprise wheel members, and said second surface engaging members comprise crawler track assemblies, and interchangeable power means for driving either said wheel members or said crawler track assemblies.

6. The combination as specified in claim 2 and power means for controlling said surface engaging members about said steering axes comprising a pair of fluid power cylinders for said pair of forward surface engaging members, said pair of fluid power cylinders being series connected so that when one of said pair of fluid power cylinders is extended the other cylinder of said pair is retracted to move said forward surface engaging members in the same direction about the steering axes, means to sense differential in position of said forward surface engaging members with respect to a reference about said steering axes, and separate fluid power control means responsive to said means to sense to provide make-up fluid to correct for incorrect relative steering positions between said forward surface engaging members.

7. The combination as specified in claim 6 and separate power means to regulate said third surface engaging member about its steering axis comprising a separate fluid power cylinder, and separate control means for controlling said separate fluid power cylinder.

8. The combination as specified in claim 7 wherein said control means for said fluid power cylinders include servo valve means, and sensor means for controlling said servo valve means, a reference line member, said sensor means being positioned at spaced locations along the length of said frame member and having elements to engage said reference line member.

9. The mobile machine as claimed in claim 1 wherein each of said surface engaging members used for steering includes a control bracket, the second ends of the links for the associated surface engaging member being pivotally connected to the associated control bracket, and means to permit steering movement including means to pivotally mount the associated surface engaging member to its associated control bracket about a substantially upright steering axis, and power means mounted between said frame member and each of said control brackets for moving the associated parallel linkage and the attached control bracket relative to said frame member, said upright steering axis being not substantially changed in orientation with respect to the vertical plane as said power means are operated.

10. The combination as specified in claim 9 wherein said power means for regulating movement of said frame member with respect to said surface engaging members through said parallel linkages comprises fluid powered cylinders, and control means for said fluid power cylinders including servo valve controls, and sensor means for sensing the position of said frame member with respect to a desired grade level.

11. The combination as specified in claim 1 and means to mount said load conveyor for movement laterally to said frame member, said means to mount said load conveyor including a pair of spaced structural support members extending in lateral direction of said frame member and forming a portion thereof, means to support said load conveyor for movement along said support members from a retracted position wherein it is substantially between the lateral side edges of said frame member, to a second position wherein one end of said load conveyor extends laterally from said frame member for receiving paving material.

12. The combination as specified in claim 11 wherein said means to support said load conveyor for movement along said support member comprises cam track means, and power means to move said load conveyor along said cam track means from its retracted position wherein the load conveyor is substantially horizontal to the second position wherein an end portion of the load conveyor extends laterally from said frame member, and the end portion of said load conveyor extending laterally from said frame member is lower than the opposite end of said load conveyor.

13. The combination as specified in claim 1 and a hood member pivotally mounted to said frame member, and being of size to cover said power means, said hood member being pivotally movable to a position wherein said power means is accessible for service.

14. The combination as specified in claim 13 and an operators console mounted on said hood member, said console being operated by an operator positioned between one end of said hood member and a reference side of said frame member, said load conveyor being positioned immediately rearwardly of said hood member, and a slip form mounted on the frame member being positioned adjacent the reference side of the frame member and extending in rearwardly direction from said load conveyor, whereby said operator can view the operable components of said machine while positioned adjacent said console.

15. A machine for forming members of a paving material using a slip form, said machine including a frame assembly, means to mount and support said frame assembly for movement along a supporting surface, said frame assembly including outer peripheral members defining a lateral side to side frame width and a frame length in a longitudinal direction, means to mount a slip form member on said machine, a load conveyor for said machine, said load conveyor having a unitary nonfoldable framework, and means to mount said load conveyor on said frame assembly comprising a pair of structural support members spaced apart in longitudinal direction of said frame assembly and extending side to side transversely of said frame assembly, said support member defining an opening at one lateral side of said frame assembly, cam track means defined on said support members, and cooperating roller means on said load conveyor movably mounted in said cam track means for guiding movement of said load conveyor, said load conveyor being movable from a first retracted position wherein a first end of said load conveyor closes the opening at one lateral side of said frame assembly to a second working position wherein said first end of said load conveyor extends laterally outwardly from said frame assembly for receiving paving material, and a second end of said load conveyor is positioned to deposit paving material carried by said load conveyor in a desired location.

16. The combination as specified in claim 15 wherein said cam track means comprises a substantially horizontal portion and an inclined track portion adjacent the opening defined in said frame, and said roller means include first and second rollers spaced lateral direction of said frame assembly, said first roller being most closely adjacent said first end of said load conveyor and moving downwardly on the inclined portion of said cam track means while said second roller remains in the substantially horizontal portion of said cam track means to cause said load conveyor to incline from said first end upwardly toward said second end when said load conveyor is in said second working position.

17. The machine of claim 15 wherein said means to mount and support said frame assembly comprises three individual ground engaging members, two of said ground engaging members being positioned adjacent the leading end of said frame assembly, and the third member being positioned adjacent the trailing end and adjacent one lateral side of said frame assembly.

18. The combination as specified in claim 17 and a power source comprising an engine and other power components mounted on said frame assembly adjacent the leading end thereof to distribute the weight thereof substantially onto said two ground engaging members adjacent the leading end of said frame assembly.

19. The combination as specified in claim 15 wherein said frame assembly includes structural support members comprising wall means defining a fuel tank and an auxiliary water tank to the rear of said load conveyor and in a position to provide when filled, counterweight for a slip form used with said machine.

20. A mobile machine for slip form paving using a paving material to form a structural comprising a frame member having a leading end and a trailing end and lateral side edges, said frame member having a load conveyor mounted thereon, and means to mount a slip form on said frame for forming said paving material into the desired structure as the machine is moved forwardly, means mounting said frame for movement along a surface comprising a pair of forward surface engaging members mounted to said frame member adjacent the leading end thereof when moving in normal direction of movement for paving, means mounting said pair of surface engaging members adjacent the side edges and within the periphery of said frame member, a single third surface engaging member, means mounting said single surface engaging member with respect to said frame member closely adjacent one side thereof and to normally move substantially in the track of one of said forward surface engaging members as the machine moves in said normal direction movement, and positioned adjacent to the rear of said frame member and laterally displaced from a slip form mounted on said machine, said means to mount a slip form being positioned to trail behind the other of said forward surface engaging members, and power means mounted on said frame for powering said surface engaging members for propelling said machine including an engine positioned adjacent the forward end of said frame member between and at least partially overlying said forward surface engaging members to tend to balance and stablize said machine, said frame including structural support members comprising wall means defining a tank for holding liquid for use with said machine positioned at the rear portion of said frame member and laterally from said single third surface engaging member in direction toward a slip form mounted on said machine so the liquid in said tank provides ballast for offsetting upward force of said slip form.

21. In a paving machine using a slip form for forming objects made of a paving material that can be poured, a frame, a plurality of ground engaging members comprising two forward ground engaging members and at least one rear ground engaging member, means mounting said frame to said ground engaging members comprising parallel linkages pivotally attached to said frame and to said ground engaging members, said rear ground engaging member being adjacent one side of the frame to provide a space for a slip form alongside the rear ground engaging member, means mounted on said frame to power at least some of said ground engaging members to drive the members to propel said frame, first power means mounted between said frame and parallel linkages to operate said parallel linkages for movement of said ground engaging members relative to said frame to lift or lower said frame, said parallel linkages including means mounting said linkages to substantially maintain the orientation of said ground engaging members with respect to a vertical reference plane as said ground engaging members are moved relative to said frame by said first power means, means individually mounting at least one of said ground engaging members about a substantially upright axis to the associated parallel linkage for steering motion with respect to its associated parallel linkage, a separate power cylinder member controlling movement of each of said ground engaging members mounted for steering motion about its associated substantially upright axis, and control means mounted on said frame for controlling the respective power cylinder means for steering movement.

* * * * *